US005453767A

United States Patent [19]

Chang et al.

[11] Patent Number: 5,453,767

[45] Date of Patent: Sep. 26, 1995

[54] METHOD FOR FORMING INK DROPLETS IN INK-JET TYPE PRINTER AND INK-JET TYPE RECORDING DEVICE

[75] Inventors: Junhua Chang; Toshihisa Saruta, both of Nagano, Japan

[73] Assignee: Seiko Epson Corporation, Tokyo, Japan

[21] Appl. No.: 89,519

[22] Filed: Jul. 21, 1993

[30] Foreign Application Priority Data

| | | | |
|---|---|---|---|
| Jul. 21, 1992 | [JP] | Japan | 4-194108 |
| Apr. 21, 1993 | [JP] | Japan | 5-094536 |
| Jun. 18, 1993 | [JP] | Japan | 5-172475 |

[51] Int. Cl.[6] ..... B41J 2/045; B41J 2/055

[52] U.S. Cl. ..... 347/10; 347/68

[58] Field of Search ..... 347/9, 10, 11, 347/12, 68, 72, 94, 69, 70, 71; 310/316, 317; B41J 2/045, 2/055

[56] References Cited

U.S. PATENT DOCUMENTS

| | | | |
|---|---|---|---|
| 4,491,851 | 1/1985 | Mizuno et al. | 347/11 |

FOREIGN PATENT DOCUMENTS

| | | | |
|---|---|---|---|
| 203534 | 12/1986 | European Pat. Off. | 347/11 |
| 62-288049 | 12/1987 | Japan . | |
| 4-1052 | 1/1992 | Japan | 347/72 |
| 4-251749 | 9/1992 | Japan | 347/10 |

*Primary Examiner*—Mark J. Reinhart
*Assistant Examiner*—Alrick Bobb
*Attorney, Agent, or Firm*—Sughrue, Mion, Zinn, Macpeak & Seas

[57] ABSTRACT

An ink-jet type recording device and a method for generating ink droplets in such a recording device in which a time difference between the leading and trailing ends of an ink column jetted out from a nozzle opening is reduced without decreasing the average speed of the ink column so as to prevent generation of satellites droplets and the like. A capacitor maintaining a voltage for expansion of a pressure generation chamber is discharged by switching a plurality of resistances differing in the discharge resistance thereof by means of switching transistors. As a result, the terminal voltage of the capacitor is caused to vary at a speed which is determined by the values of the resistances. Therefore, by selecting the values of the resistances such that the absolute value of the differential value of the terminal voltage increases with time, the rate of contraction of the pressure generation chamber can be increased gradually to thereby minimize a speed difference between the leading and trailing ends of the ink column.

8 Claims, 9 Drawing Sheets

FIG. 2(III)
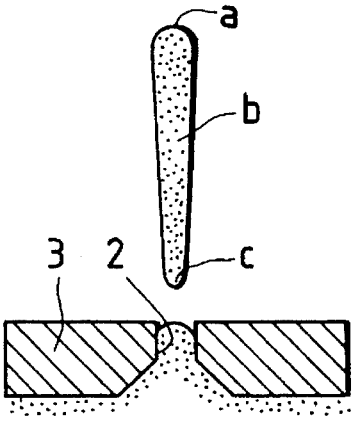

METHOD FOR FORMING INK DROPLETS IN INK-JET TYPE PRINTER AND INK-JET TYPE RECORDING DEVICE

BACKGROUND OF THE INVENTION

The present invention relates to an on-demand type ink-jet recording device and, in particular, to a technique for driving a recording head of an on-demand type ink-jet recording device.

A conventional on-demand type of ink-jet recording device has a recording head which includes a plurality of pressure generation chambers for generating an ink pressure by means of piezoelectric vibrators or heating elements, a common reservoir for supplying ink to the respective pressure generation chambers, and nozzle openings communicating with the respective pressure generation chambers. In the recording head a drive signal is applied to the pressure generation chambers corresponding to a print signal to thereby jet out ink droplets from the nozzle openings onto a recording medium.

Such an ink-jet recording head can be classified into two types: one a bubble-jet type in which a resistance wire, as pressure generation means, generates Joule heat in a pressure generation chamber responsive to a drive signal, and the other a piezoelectric vibration type in which part of a pressure generation chamber is formed by a diaphragm and the diaphragm is compressed and shifted by means of a piezoelectric vibrator.

Since the former type utilizes the vapor pressure of the ink solvent vaporized instantaneously due to the heat generation of the resistance wire, only a small quantity of ink in the form of droplets can be jetted out, which makes it possible to realize printing at a high resolution as well as quick drying of the ink droplets. However, the heat generation of the resistance wire can cause the ink and recording head to deteriorate in quality readily.

According to the latter type, since no heat is generated, the quality of the ink is not deteriorated, the recording head has a longer permanent life, and operating costs are low. On the other hand, since a sufficient volumetric change is required to allow the generation of the ink droplets, the quantity of the ink droplets is great and the time necessary to dry the ink droplets is long.

Also, in the latter type, due to the fact that the volume of the pressure generation chamber is abruptly changed to thereby generate pressure, the ink is caused to fly in a column-like stream (similar to water shot from a water pistol), so that there is a time difference or a speed difference between the leading and trailing end portions of the flying ink, with the result that unwanted small ink droplets are generated, causing the printed dot to be distorted.

In order to solve the above-mentioned problems, as disclosed in Japanese Patent Publication No. Sho. 59-133067, there has been proposed a technique in which, after application of a drive signal to generate ink droplets, an auxiliary pulse is applied at a predetermined time instant to thereby forcibly stop the jetting-out of the ink in order to reduce the size of the ink column.

According to this technique, the generation of the small ink droplets incidental to the tail end of the ink column is prevented, that is, the generation of so-called "satellite" ink droplets is prevented, so that the printed dots can be made circular.

However, in this technique, since it is necessary to generate two types of pulses, that is, the drive pulse and auxiliary pulse at respective timings, the structure of the drive circuit is complicated. Also since the piezoelectric vibrator is driven against the inertia of a member forming a pressure generation chamber, a high force acts on the piezoelectric vibrator and the pressure generation chamber forming member, which results in a reduced life of the recording head.

SUMMARY OF THE INVENTION

The present invention is directed towards eliminating the problems in the above-mentioned conventional ink-jet recording devices. Accordingly, it is an object of the invention to provide an on-demand type ink-jet recording device which does not apply an unreasonably high force to a piezoelectric vibrator and a pressure generation chamber forming member, but can reduce the length of ink droplets jetted from the nozzle openings, that is, the length extending from the leading end to the trailing end thereof, or a time difference between the passing of the leading and trailing ends of the ink droplets, to thereby form spherical droplets and circular dots on the printed page.

In attaining the above and other objects, according to the invention there is provided a method for driving an ink-jet recording head including flow path forming means having a nozzle opening and adapted to be able to vary the volume of a pressure generation chamber by means of a piezoelectric vibrator when the chamber receives ink supplied from an ink reservoir, the method comprising a first step of expanding the pressure generation chamber to thereby suck in ink, a second step of contracting the pressure generation chamber at a first speed, and a third step of contracting the pressure generation chamber at a second speed switched from the first speed, the first speed being set smaller than the second speed.

After a given period of time from the beginning of ink jetting, the contracting speed of the pressure generation chamber is increased to thereby enhance the ink jetting speed. As a result, ink can be jetted out continuously in such a manner that the ink follows and catches up with the leading end of the ink jetted out previously. For this reason, the speed difference between the leading and trailing ends of the ink column is decreased to thereby allow a spherical ink droplet to reach the recording paper.

DESCRIPTION OF THE PREFERRED EMBODIMENTS

A description will be given hereinbelow given in detail of the invention by way of preferred embodiments thereof.

Figure 1:
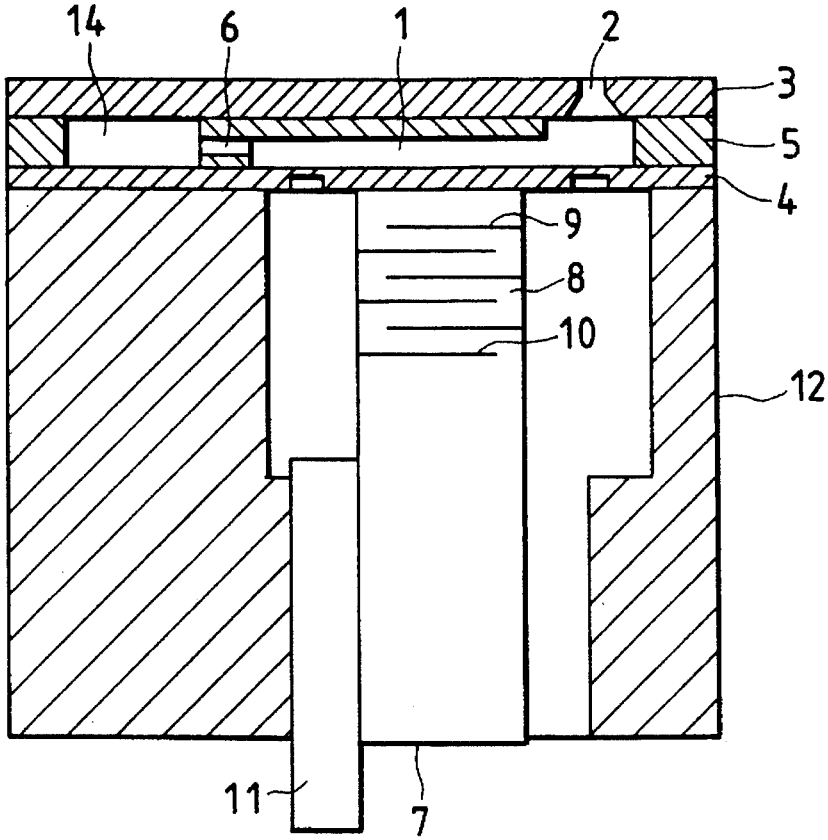
FIG. 1 is a section view of an embodiment of an ink-jet type recording head to which the invention is applied.

Referring to FIG. 1, there is shown an embodiment of an ink-jet recording head which is driven by a head drive circuit according to the invention. In FIG. 1, reference numeral 1 designates a pressure generation chamber formed by a nozzle plate 3 having a nozzle opening 2 therein, a vibration plate 4 in contact with the leading end of a piezoelectric vibrator (described below), and a spacer 5 held between the nozzle plate 3 and vibration plate 4. The pressure generation chamber 1 receives ink through an ink supply port 6 from a reservoir 14 which is connected to an ink tank (not shown).

Reference numeral 7 designates the above-mentioned piezoelectric vibrator. In the present embodiment, the vibrator 7 is constructed in a laminated structure in which a piezoelectric material 8 and electrode-forming materials 9 and 10 are arranged in a sandwiched manner. The vibrator 7 further includes an inactive area which does not contribute to vibration and is fixed to a fixing base plate 11. The fixing base plate 11, nozzle plate 3, spacer 5 and vibration plate 4 are fixed together integrally through a base member 12 to thereby form an ink-jet recording head.

Figure 2I:
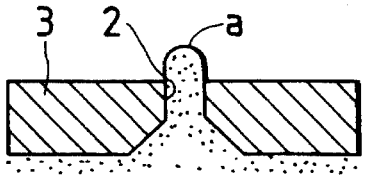
FIGS. 2(I), 2(II), and 2(III) are respective explanatory views depicting an ink droplet generating process performed by the above ink-jet type recording head.
Figure 2:
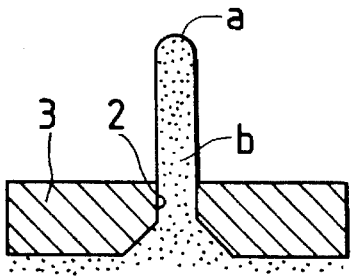

In the ink-jet recording head constructed in this manner, when a voltage is applied to the electrodes 9 and 10 of the piezoelectric vibrator 7, the piezoelectric vibrator 7 is caused to extend toward the nozzle plate 3 to displace the vibration plate 4, so that the volume of the pressure generation chamber 1 is reduced. A bias voltage of 30 V is previously applied to the piezoelectric vibrator 7 and, from this state, if the bias voltage is decreased to 0 V, then the piezoelectric vibrator 7 is caused to contract. This draws the meniscus of the nozzle opening toward the pressure generation chamber 1 and, at the same time, the ink in the reservoir 14 is allowed to flow through the ink supply port into the pressure generation chamber 1. Subsequently, if the bias voltage is increased, then the piezoelectric vibrator 7 is expanded to thereby cause the vibration plate 4 to compress the pressure generation chamber 1. As a result, the ink in the pressure generation chamber 1 is pushed out into the nozzle opening 2 and ink supply port 6. That is, the leading end portion a of the ink is projected out from the nozzle opening 2 (FIG. 2(I)), then it follows the displacement of the vibration plate 4 and is jetted out in the form of a liquid column (FIG. 2(II)). The liquid column is broken off after expansion of the piezoelectric vibrator 7 is stopped. The trailing end portion c of the liquid column is discharged from the nozzle opening 2 in a such manner to chase the leading end portion a (FIG. 2(III)). The liquid column flies toward the recording paper at the speed of expansion of the piezoelectric vibrator 7, that is, at a speed proportional to the rate of contraction of the pressure generation chamber 1, forming a dot on the recording paper.

Figure 3:
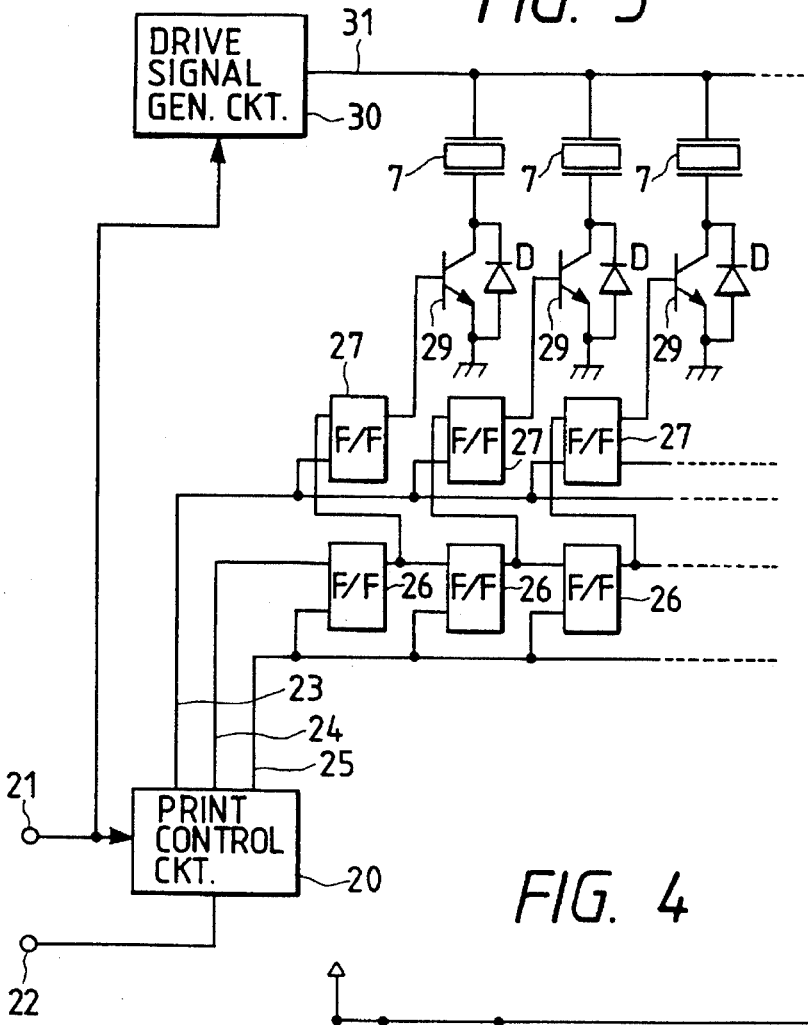
FIG. 3 is a block diagram of an embodiment of a drive device employed in a recording device according to the invention.

In FIG. 3 there is shown an embodiment of a drive circuit which is used to drive the above-mentioned recording head. In FIG. 3, reference numeral 20 designates a print control circuit. A timing signal from an external device is input to a terminal 21 of the print control circuit 20, and a print signal from an external device is input to a terminal 22. The print control circuit 20 outputs a latch signal from a terminal 23, a print signal from a terminal 24, and a shift clock signal from a terminal 25.

The print signal from the terminal 24 is shifted by the shift clock signal from the terminal 25 through flip-flop circuits 26 sequentially, and also is temporarily stored and held by the latch signal from the terminal 23 in flip-flop circuits 27.

Reference numeral 30 designates a drive signal generation circuit which generates a drive signal identical to the timing signal input to the terminal 21 from the external device and outputs the drive signal to the one-side electrodes of respectively connected piezoelectric vibrators 7 in parallel to a terminal 31.

In FIG. 3, reference numerals 29 designate switching transistors which are connected between the other-side electrodes of the piezoelectric vibrators 7 and ground. Diodes D are also electrically connected between the other-side electrodes of the piezoelectric vibrators 7 and ground in parallel with each switching transistor 29. The switching transistors 29 are turned on responsive to signals from the flip-flop circuits 27, and apply the drive signal from the drive signal generation circuit 30 to the selected piezoelectric vibrators 7.

Figure 4:
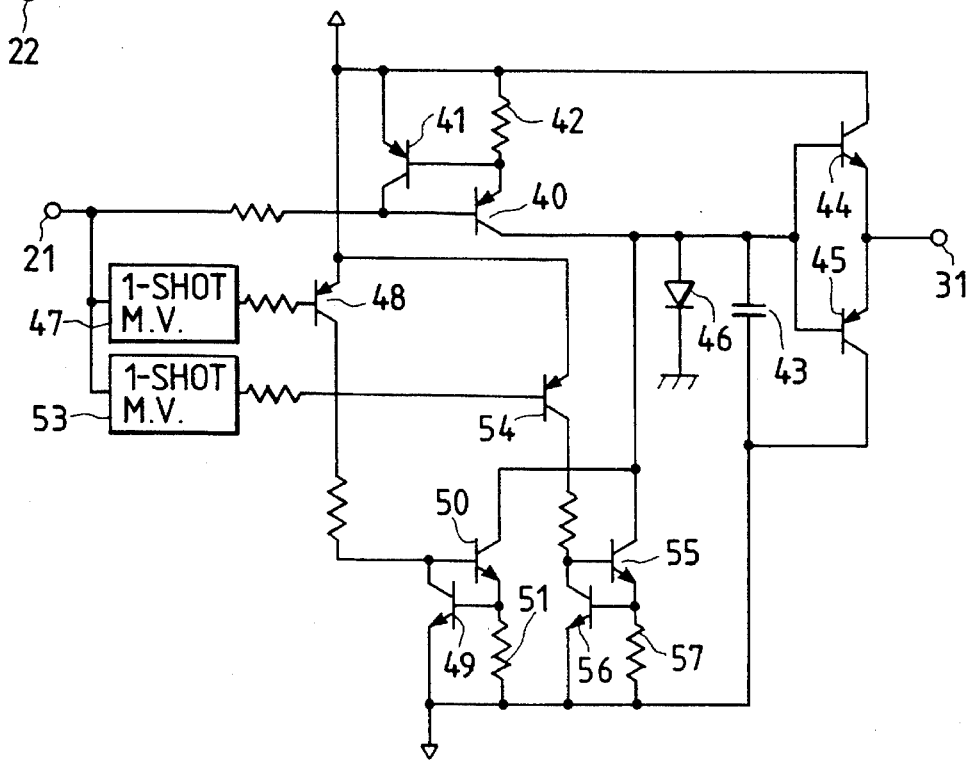
FIG. 4 is a circuit diagram of an embodiment of a drive signal generation circuit included in the above drive device.

Referring now to FIG. 4, there is shown an embodiment of the above-mentioned drive signal generation circuit 30, in which, when the timing signal is input to the terminal 21, a transistor 40 is turned on and, in cooperation with a transistor 41 which is paired with the transistor 40 to form a current mirror circuit, the transistor 40 charges a capacitor 43 with a given current whose magnitude is determined by a resistance 42. The terminal voltage of the capacitor 43 generated in this charging process is amplified by a circuit composed of the transistors 44 and 45 and is then applied to the terminal 31.

When the capacitor 43 is charged up to $V_H$ (30 V) in this manner, a diode 46 starts to conduct, and thus the terminal voltage of the capacitor 43 is held at a constant voltage, that is, at 0 V.

Figure 5:
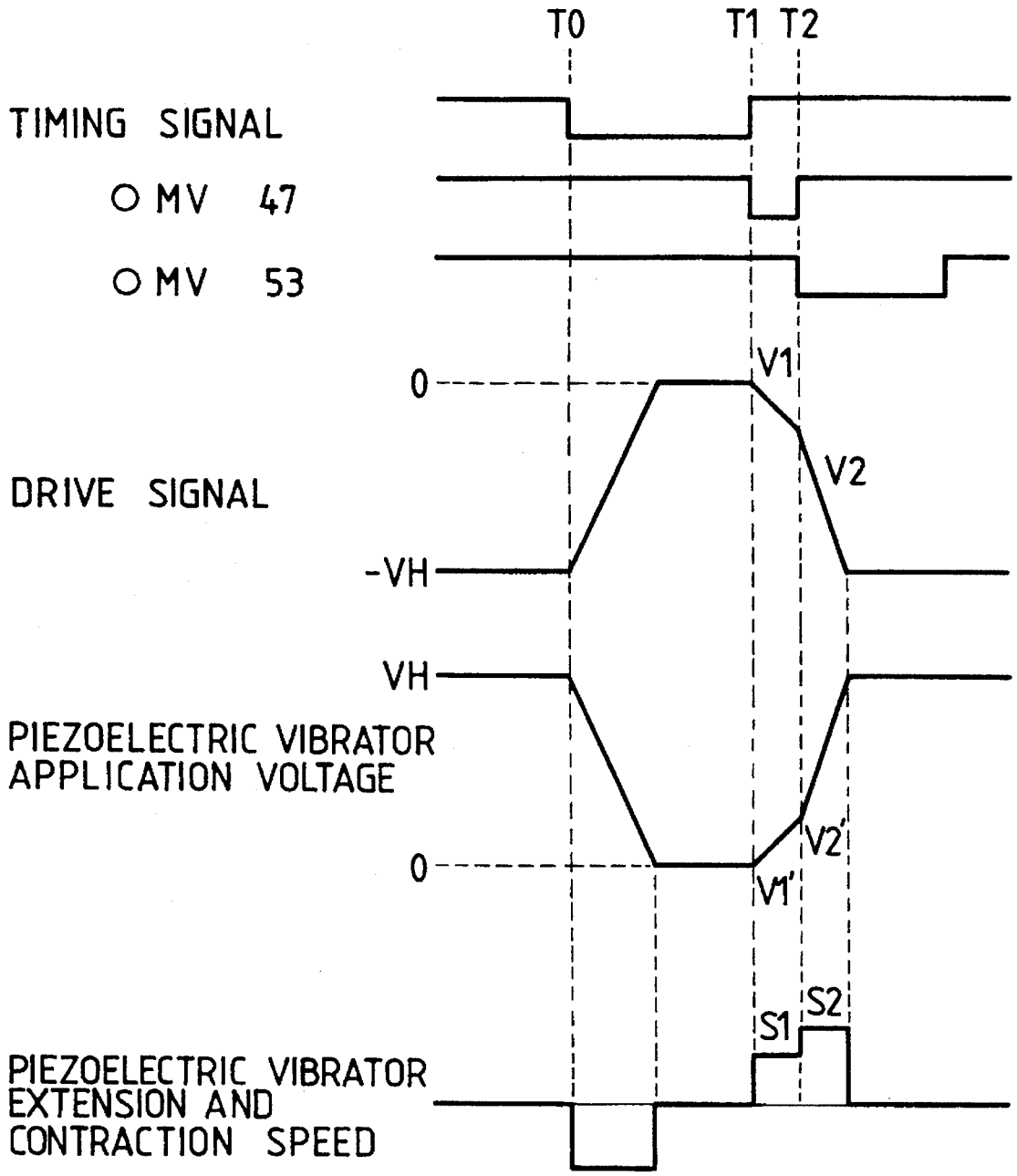
FIG. 5 is a timing chart of the operation of the above drive device.

As shown in FIG. 5 after a given time, i.e., from the time $T_o$ to the time $T_1$, has passed and thus the timing signal rises, the transistor 40 is turned off and, at the same time, a one-shot multivibrator 47 is operated at the rising edge of the timing signal. This causes a transistor 48 to turn on and, therefore, transistors 49 and 50 are also turned on, so that the capacitor 43 is discharged with a given current whose magnitude is determined by a resistance 51. The terminal voltage of the capacitor 43 resulting from this discharge is amplified by the two transistors 44 and 45, and it is then output to the terminal 31.

Once a time period (from the time $T_1$ to the time $T_2$, see FIG. 5) determined by the one-shot multivibrator 47 has passed, the transistor 48 is turned off, and at the same time a one-shot multivibrator 53 is operated and a transistor 54 is turned on. This causes transistors 55 and 56 to turn on. The capacitor 43 continues to discharge with a given current determined by a resistance 57. The terminal voltage of the capacitor 43, which varies according to the resistance 57, is amplified by the transistors 44 and 45 and then output to the terminal 31.

By switching between the two discharge resistances 51 and 57 in the discharge process in the above-described manner, the absolute values of the differential coefficients of the voltage signals V1 and V2 applied to expand the piezoelectric vibrator 7 are caused to vary with time. As a result, as the piezoelectric vibrator 7 is expanded, its expansion speed is increased from S1 to S2, and thus the displacement speed of the vibrator 4, which is mounted on the piezoelectric vibrator 7, is also increased.

Consequently, the ink pressure generated in the pressure generation chamber 1 is also increased so that the speed of the ink column is increased as time passes when the ink column is ejected from the nozzle opening 2.

In the above-mentioned drive signal generation circuit, if the capacitance of the capacitor 43 is expressed as C, the current for charging the capacitor 43 as $I_r$, the value of the resistance 42 as $R_r$, the value of the resistance 51 as $R_{f1}$, the value of the resistance 57 as $R_{f2}$, the base-emitter voltages of the transistors 40, 50 and 55 as $V_{be\text{-}40}$, $V_{be\text{-}50}$ and $V_{be\text{-}55}$, the discharge current through the resistance 51 as $I_{f1}$, and the discharge current the resistance 57 as $I_{f2}$, then the following equations are obtained:

$$I_r=V_{be\text{-}40}/R_r$$
$$I_{f1}=V_{be\text{-}50}/R_{f1}$$
$$I_{f2}=V_{be\text{-}55}/R_{f2}$$
$$T=C\times V_H/I_r$$
$$T_{fall\text{-}1}=C\times V_H/I_{f1}$$
$$T_{fall\text{-}2}=C\times V_H/I_{f2}$$

Figure 6A:
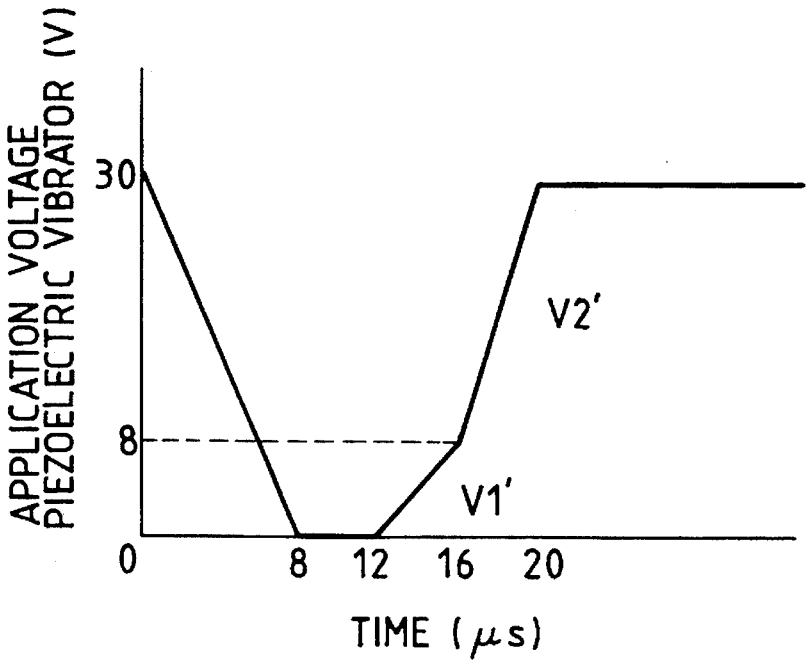
FIGS. 6(A) and 6(B) are respectively graphical representations of the changes with time of the voltage applied to the piezoelectric vibrator and the changes in extension and contraction speed with time, illustrating a case in which a drive waveform in the above drive device is applied to an actual device.
Figure 6B:
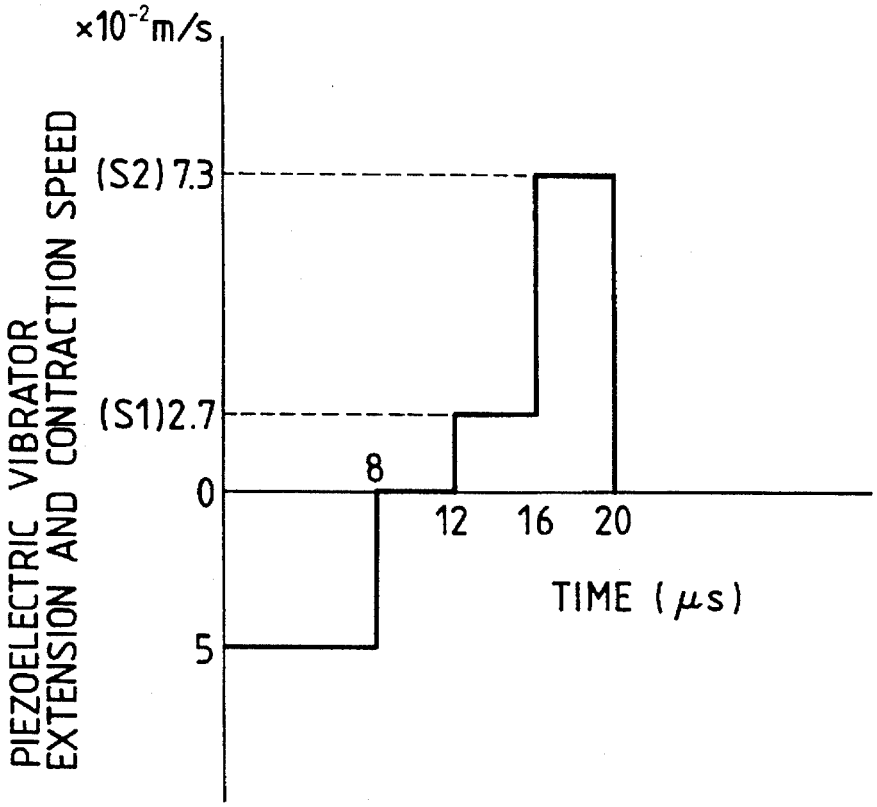

FIGS. 6(A) and 6(B) show the relation between the changes with time of the application voltage of the piezoelectric vibrator in an actual device constructed according to the above-described embodiment of the inventive drive device and the expansion and contraction speed of the piezoelectric vibrator due to the application voltage, that is, the volumetric speed of the pressure generation chamber. In FIG. 6(A), a signal V1' having a given gradient just before the jetting out of the ink droplets is applied for a period of time of 4 μs, and then a signal V2' having a larger gradient than the given gradient is applied. This causes the piezoelectric vibrator to start its expansion at a speed S1 (for example, $2.7\times10^{-2}$ m/s) and, after a lapse of 4 μs, to expand at a speed S2 (for example, $7.3\times10^{-2}$ m/s) which is greater than the speed S1 (FIG. 6(B)). As shown in FIG. 6(A), the application voltage remains constant (at 0 volts in FIG. 6(A), i.e., a "hold" voltage) for a period of time of 4 μs between the application of the first drive signal (negative slope contraction of the piezoelectric vibrator) and the second drive signal (positive slope with two different components, i.e., V1 and V2—extension of the piezoelectric vibrator). Likewise, in FIG. 6(B), the extension and contraction speed is 0 during the application of the hold voltage, and the piezoelectric vibrator is contracted during the first 8 μs at a constant rate of $-5\times10^{-2}$ m/s, and expanded from 12 μs to 16 μs at a constant rate of $2.7\times10^{-2}$ m/s and from 16 μs to 20 μs at an increased constant rate of $7.3\times10^{-2}$ m/s.

Figure 7:
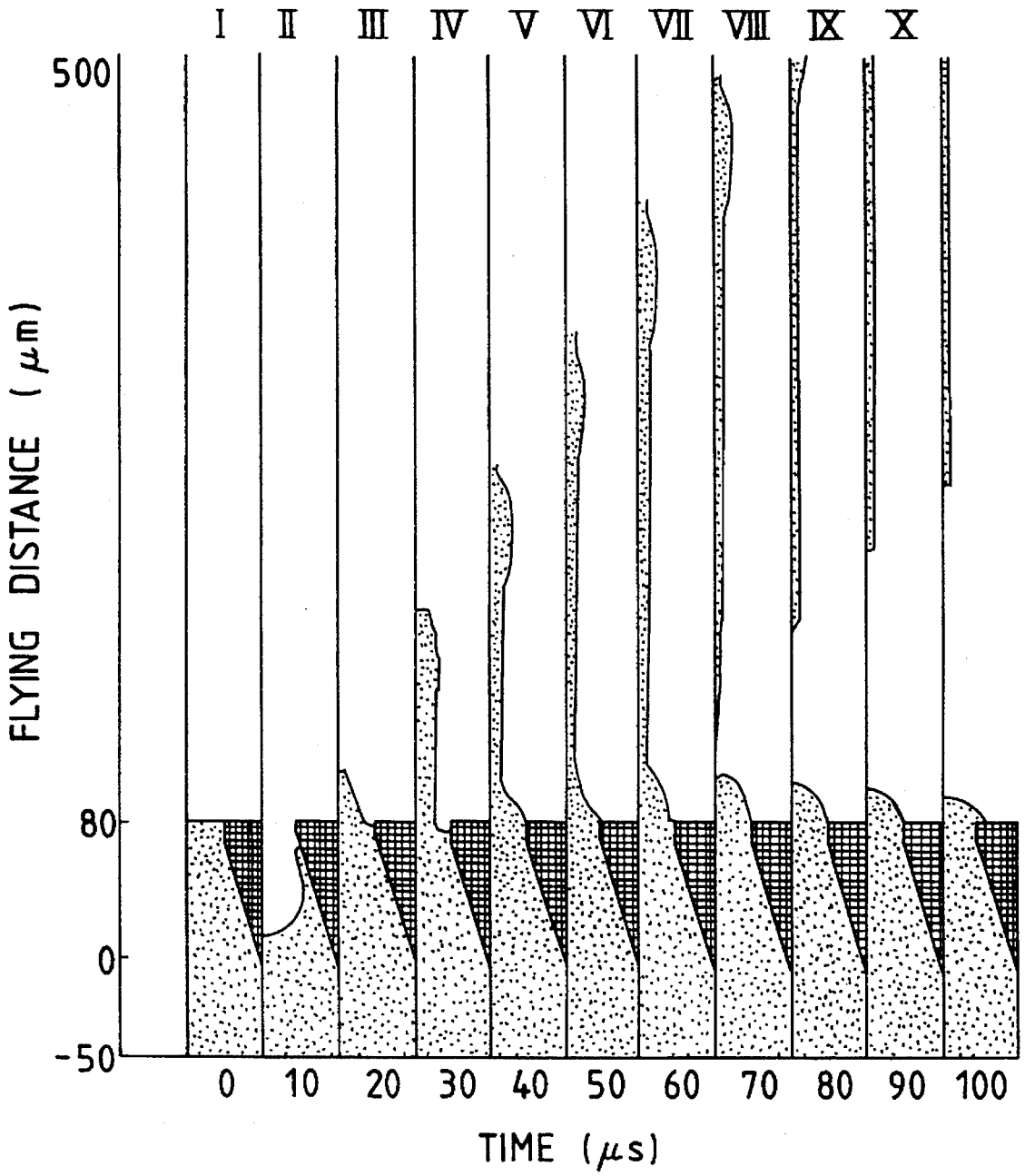
FIG. 7 is a view of simulations of the flying states of ink droplets obtained when an ink-jet type recording head is driven by means of a drive signal according to the invention.

As a result, as shown in FIG. 7, with respect to the speed distribution of an ink column at the instant the ink column parts from the nozzle opening, the average speed of the ink droplet leading end is 7.6 m/s, and the average speed of the ink droplet trailing end is 4.4 m/s, so that the difference between the speeds of the two ends is 3.2 m/s.

Figure 8:
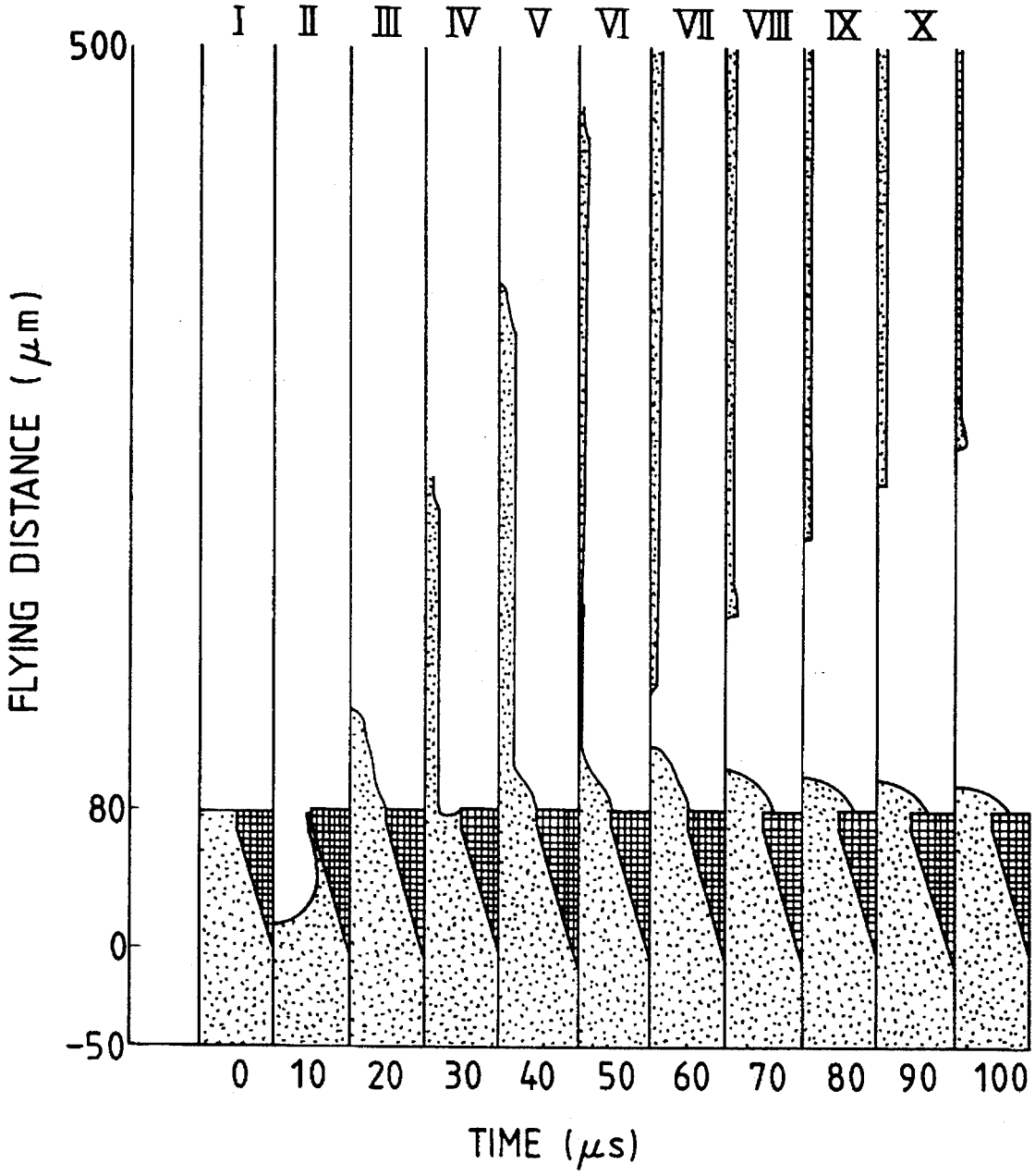
FIG. 8 is a view of simulations of the flying states of ink droplets obtained when an ink-jet type recording head is driven by a conventional technique.

On the other hand, in a conventional drive technique which uses a drive voltage of a trapezoidal waveform in which the gradient of the drive signal is held constant, with respect to the speed distribution of an ink column at the instant the ink column parts from the nozzle opening (FIG. 8 (II)), the average speed of the ink droplet leading end is 11.1 m/s, and the average speed of the ink droplet trailing end is 3.5 m/s, so that the difference between the speeds of the two ends is 7.6 m/s.

As can be clearly understood from the above data, in accordance with the driving method according to the invention, when compared with the conventional driving technique, the speed of the leading end of the ink droplet is small while the speed of the trailing end thereof is greater than the leading end speed, so that the difference between the speeds of the leading and trailing ends of the ink droplet can be reduced by one-half or less.

In other words, in the case of the ink column produced according to the invention, at the instant the trailing end thereof parts from the nozzle opening, the leading end has reached only a distance of the order of 500 μm from the nozzle opening (see FIG. 7 (VIII)). On the other hand, in the case of an ink column produced according to the conventional driving technique, the leading end thereof has flown 500 μm or more, that is, as can be clearly seen from FIG. 8 (VII), it has flown outside of the view of FIG. 8.

Also, according to the invention, due to the fact that the speed variation from the rest state of the ink just before generation of the ink droplet to jetting out of the ink droplet can be set smaller than in the conventional driving method, the shock acting on the piezoelectric vibrator and vibration plate at the time of jetting out of the ink droplet can be made smaller. This reduces the fatigue of the vibration plate and piezoelectric vibrator and also reduces the shocks that are propagated to other adjoining pressure generation chambers thereby to reduce crosstalk.

In the present embodiment, the timing signal for generation of the drive signal is produced by the drive signal generation circuit. Alternatively, however, the timing signal may be generated by the control signal generation circuit. In this case as well, it is clear that a similar action can be provided.

Figure 9A:
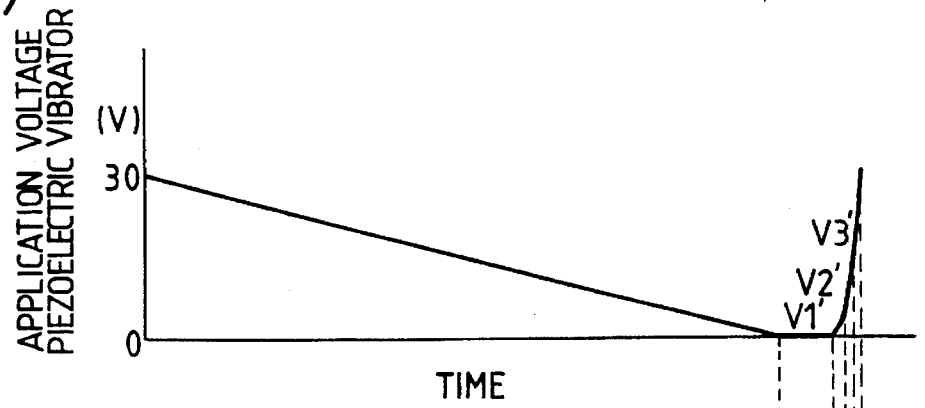
FIGS. 9(A) and (B) are graphical representations of the changes with time of the voltage and the extension and contraction speed of a piezoelectric vibrator in another embodiment according to the invention.
Figure 9B:
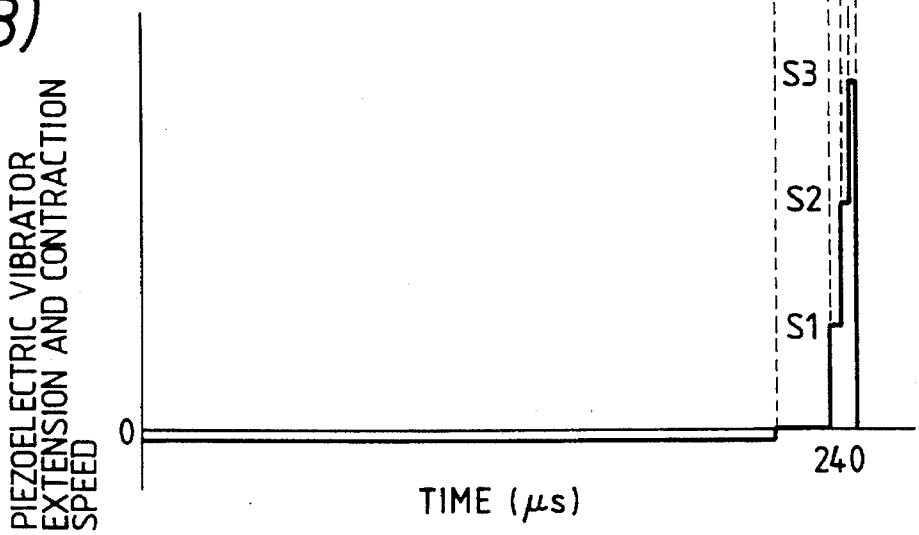

Also, in the description of the above-mentioned embodiment, for the purpose of simplifying the description, two gradients are employed for the drive signal to be applied when the piezoelectric vibrator is expanded. However, alternatively, as shown in FIGS. 9(A) and 9(B), there can be employed three or more gradients, the absolute values of which increase with time. In this case, three signals V1', V2' and V3' differing in the absolute values of the differential coefficients thereof from each other are applied to the piezoelectric vibrator so that the piezoelectric vibrator is expanded at speeds S1, S2 and S3 which increase gradually. As a result, the speeds of the leading end, central portion and trailing end of the ink column can be made to approach further to each other so as to more surely prevent generation of so-called "satellite" ink droplets, that is, unwanted very fine ink droplets.

Figure 10:
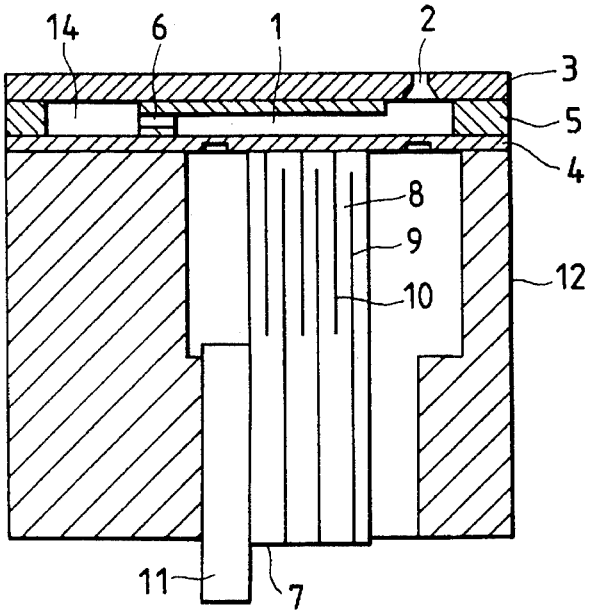
FIG. 10 is a section view of an embodiment of another type of ink-jet recording head to which the present invention can be applied.
Figure 11A:
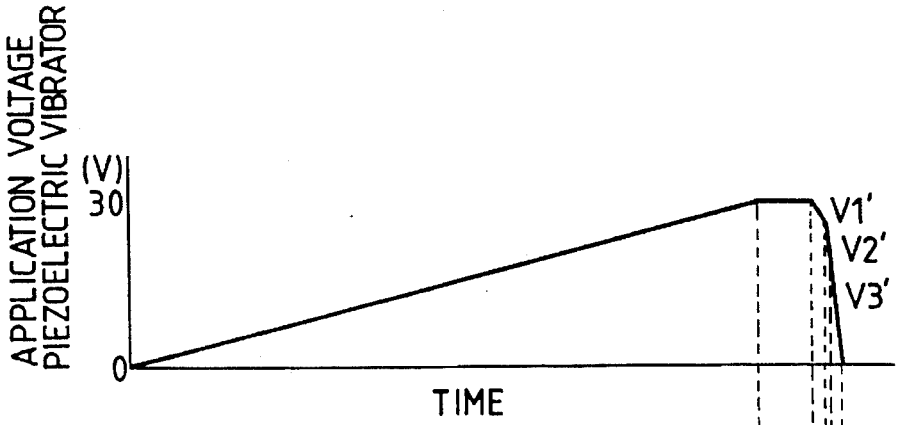
FIGS. 11(A) and (B) are graphical representations of the changes with time of the voltage applied to the piezoelectric vibrator so as to drive the above recording head of the invention, and the changes with time of the extension and contraction speed of the piezoelectric vibrator.
Figure 11B:
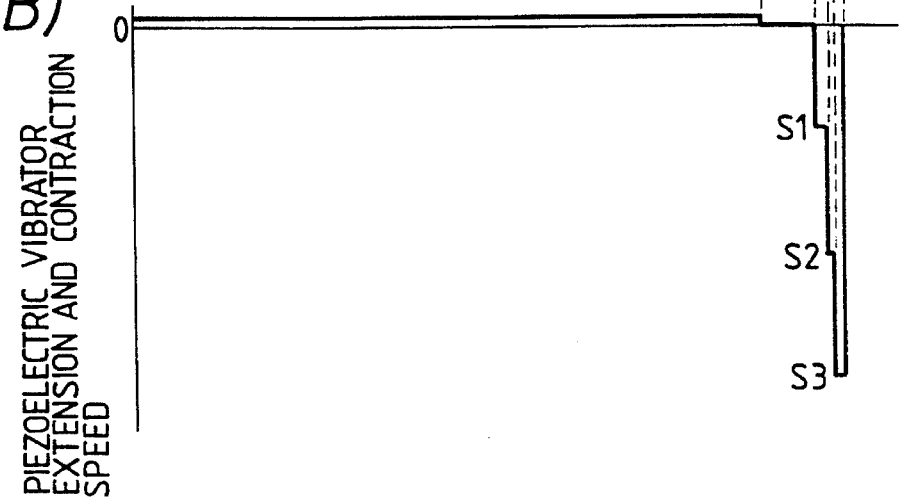

Further, in the above embodiment there is employed a piezoelectric vibrator which expands when a voltage is applied thereto. However, as shown in FIG. 10, a similar effect can be obtained in the case of an ink-jet recording head of a type that a piezoelectric vibrator is contracted to thereby expand a pressure chamber when a drive signal as shown in FIGS. 11(A) and 11(B) is applied to the piezoblectric vibrator.

Moreover, in the above embodiment, a description has been given of a case in which first the pressure generation chamber 1 expands and then it contracts. However, it is obvious that a similar action can also be obtained when the invention is applied to an ink-jet recording head in which, at the time when the timing signal is output, the pressure generation chamber 1 contracts to thereby generate an ink droplet and thus form a dot and, after the dot is formed, the pressure generation chamber 1 expands to its original state.

Figure 12:
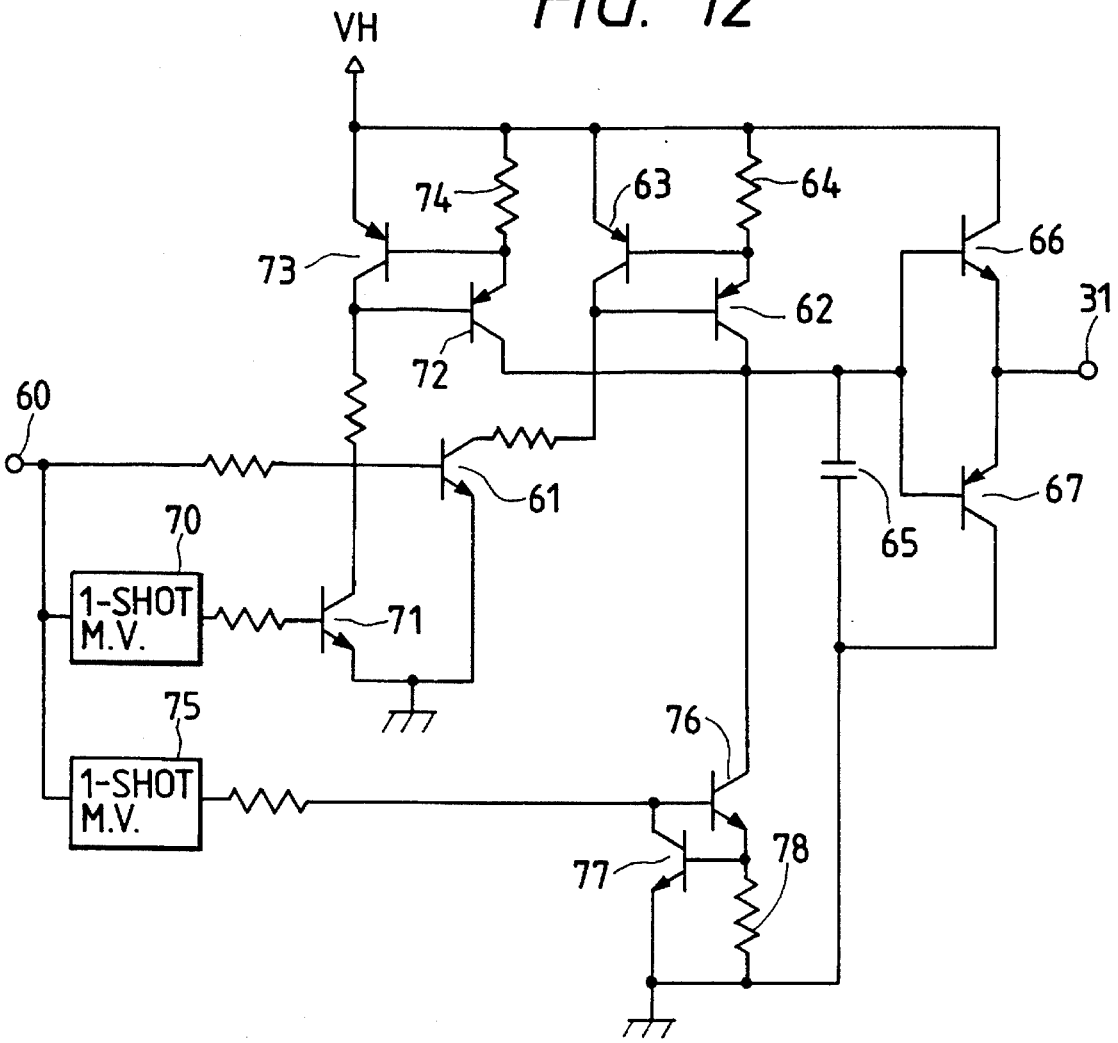
FIG. 12 is a circuit diagram of another embodiment of a drive signal generation circuit employed in the present invention.
Figure 13:
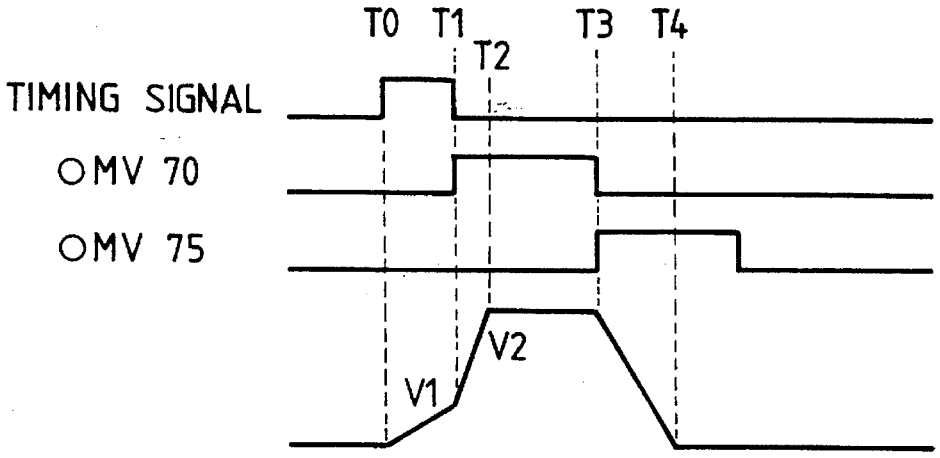
FIG. 13 is a waveform chart of the operation of the above device.

Referring now to FIG. 12, there is shown an embodiment of a drive signal generation circuit suitable for the latter type of recording head. In FIG. 12, when a timing signal is input to a terminal 60 (FIG. 13, TO), then a transistor 61 is turned on to thereby turn on a transistor 62. As a result, the transistor 62, in cooperation with a transistor 63 which is paired with the transistor 62 to form a current mirror circuit, charges a capacitor 65 with a given current whose magnitude is determined by a resistance 64. The terminal voltage of the capacitor 65 produced in this charging process is amplified by a circuit comprising transistors 66 and 67, and is then output to the terminal 31 as a signal V1. When the signal V1 is applied to the piezoelectric vibrator, the piezoelectric vibrator expands according to a differential value determined by the value of a resistance 64, thereby generating an ink droplet.

Since the timing signal falls at a time T1 after a given time has elapsed, the transistor 61 is turned off, while there is output a pulse signal from a one-shot multivibrator 70 to thereby turn on a transistor 71. When the transistor 71 turns on, then a transistor 72, which is paired with the transistor 73 in a current mirror circuit, is turned on and thus continues to charge the capacitor 65 with a given current determined by the value of the resistance 74. The terminal voltage of the capacitor 65 is amplified by the transistors 66 and 67, and is then output to the terminal 31 as a signal V2, with the result that the piezoelectric vibrator 7 expands up to a time T2 according to a differential value determined by the resistance 74.

The signal is set by selecting the value of the resistance 74 such that the absolute value of the differential value is greater than that of the signal V1 just before the signal V2. That is, as described before, the signal V2 allows generation of an ink column including a portion having a higher speed than that of the leading end of an ink column generated by the signal V1.

In this manner, at the time T2 when the capacitor is charged up to a drive voltage $V_H$, a given voltage is maintained. When a pulse signal from the one-shot multivibrator 70 rises (T3), the transistor 71 is turned off. Then, a pulse is output from one-shot multivibrator 75 to turn on a transistor 76. This allows a transistor 77, which is paired with the transistor 76 in a current mirror circuit, to discharge the capacitor 65 with a given current whose magnitude is determined by a resistance 78. The terminal voltage of the capacitor 65 in this discharging process is current amplified by the transistors 66 and 67, and is then output to the terminal 31, thereby causing the piezoelectric vibrator 7 to contract at a given speed. As a result, the pressure generation chamber 1 expands to its original state and, during this process, ink is supplied from the reservoir to the pressure generation chamber so as to prepare for forming the next dot.

In the above embodiment, a description has been given of a case in which the degree of expansion of the piezoelectric vibrator is proportional to the rate of contraction of the pressure generation chamber. It is also obvious that, if there exists a non-linear relation between the degree of expansion of the piezoelectric vibrator and the rate of contraction of the pressure generation chamber, then the increment of the drive voltage may be set in consideration of the non-linear relation.

Also, in the above embodiment there are used a plurality of discharge resistances and a plurality of switching circuits for selecting the discharge resistances, and the switching circuits are selected and switched by use of the timing signals to thereby vary the gradient of the drive signal. However, it is clear that a similar action can be obtained in another manner in which analog switching circuits are driven in accordance with a signal from a digital waveform shaping circuit to thereby change the impedance of a discharge passage with time.

As has been described above, according to the invention, there is provided an ink droplet forming method which comprises a step of contracting the pressure generation chamber at a first speed and a step of contracting the pressure generation chamber at a second speed different from the first speed, wherein the second speed is greater than the first speed. Accordingly, it is possible to minimize as much as possible the length of the ink column jetted from the nozzle opening, that is, the length extending from the leading end of the droplet to the trailing end thereof, to thereby form a spherical ink droplet. This makes it possible to prevent generation of satellite ink droplets and thus improves printing quality.

Also, according to the invention, since it is possible to minimize the first voltage which is applied to compress the pressure generation chamber in order to generate an ink droplet, it is possible to reduce the amount of shock acting on the vibration plate and piezoelectric vibrator at the beginning of the jetting-out of the ink droplets, which in turn makes it possible to reduce the fatigue of the vibration plate and piezoelectric vibrator as well as to minimize crosstalk.

What is claimed is:

1. An ink droplet forming method for driving an ink-jet type recording head including a pressure generation chamber which receives ink supplied from a reservoir, a flow passage forming member associated with said pressure generation chamber and having a nozzle opening, and a piezoelectric vibrator associated with said pressure generation chamber for varying a volume of said pressure generation chamber to jet ink droplets from said pressure generation chamber through said nozzle opening in said flow passage forming chamber, said method comprising the steps of:

expanding said pressure generation chamber to thereby suck ink into said pressure generation chamber;

contracting said pressure generation chamber at a first speed during a first time period to commence jetting of an ink droplet through said nozzle, said first speed being constant during said first time period; and contracting said pressure generation chamber at a second speed during a second time period different from said first speed while said ink droplet continues to be jetted through said nozzle, said second speed being constant during said second time period and greater than said first speed, said second time period being immediately subsequent to said first time period.

2. An ink droplet forming method for driving an ink-jet type recording head including a pressure generation chamber which receives ink supplied from a reservoir, a flow passage forming member associated with said pressure generation chamber and having a nozzle opening, and a piezoelectric vibrator associated with said pressure generation chamber for varying a volume of said pressure generation chamber to jet ink droplets from said pressure generation chamber through said nozzle opening in said flow passage forming member, said method comprising the steps of:

contracting said pressure generation chamber at a first speed during a first time period to commence jetting of an ink droplet through said nozzle, said first speed being constant during said first time period;

contracting said pressure generation chamber at a second speed during a second time period different from said first speed while said ink droplet continues to be jetted through said nozzle, said second speed being constant during said second time period and greater than said first speed, said second time period being immediately subsequent to said first time period; and expanding said pressure generation chamber to thereby suck ink into said pressure generation chamber.

3. An ink-jet type recording device comprising:

an ink-jet type recording head including a pressure chamber which receives ink supplied from a reservoir;

a flow passage forming member associated with said pressure generation chamber and having a nozzle opening;

a piezoelectric vibrator associated with said pressure generation chamber for varying a volume of said pressure generation chamber to jet ink droplets from said pressure generation chamber through said nozzle opening in said flow passage forming member; and a drive circuit for producing a first drive signal in response to a timing signal, said first drive signal being applied to said piezoelectric vibrator to expand said pressure generation chamber to thereby suck ink into said pressure generation chamber, and, after completion of expansion of said pressure generation chamber, for producing a second drive signal including at least two parts one after another whose differential functions are constants, which are applied to said pressure generation chamber to cause said pressure generation chamber to contract, said constants having different absolute values, said absolute values increasing with time.

4. The ink-jet type recording device as set forth in claim 3, wherein said drive circuit further produces a hold signal having a voltage which is held constant for a predetermined period of time between said first and second drive signals.

5. The ink-jet type recording device as set forth in claim 3, wherein said drive circuit comprises first switching means which is turned on in accordance with said timing signal to thereby charge a capacitor, and a plurality of second switching means which are turned on one by one after completion of charging of said capacitor to thereby discharge said capacitor with different constant current values.

6. An ink-jet type recording device comprising:

an ink-jet type recording head including a pressure chamber which receives ink supplied from a reservoir;

a flow passage forming member associated with said pressure generation chamber and having a nozzle opening;

a piezoelectric vibrator associated with said pressure generation chamber for varying a volume of said pressure generation chamber to jet ink droplets from said pressure generation chamber through said nozzle opening in said flow passage forming member; and a drive circuit for outputting a first drive signal including at least two voltage signals one after another whose differential functions are constants in response to timing signals, said pressure generation chamber contracting in response to said voltage signals, said constants having different absolute values from each other, said absolute values increasing with time and, after completion of said first drive signal, for outputting a second drive signal, said pressure generation chamber expanding in response to said second drive signal.

7. The ink-jet type recording device as set forth in claim 6, wherein said drive circuit further produces a hold signal having a voltage which is held constant for a predetermined period of time between said first and second drive signals.

8. The ink-jet type recording device as set forth in claim 6, wherein said drive circuit comprises first switching means which is turned on one by one in accordance with said timing signal to thereby charge a capacitor, and a plurality of second switching means which are turned on after completion of charging of said capacitor to thereby discharge said capacitor with different constant current values.

* * * * *